US006827558B2

(12) United States Patent
Hauser et al.

(10) Patent No.: US 6,827,558 B2
(45) Date of Patent: Dec. 7, 2004

(54) MEASURING GAS PUMP

(75) Inventors: Erwin Hauser, Emmendingen (DE); Erich Becker, Bad Krozingen (DE)

(73) Assignee: KNF Neuberger GmbH, Freiburg (DE)

( * ) Notice: Subject to any disclaimer, the term of this patent is extended or adjusted under 35 U.S.C. 154(b) by 69 days.

(21) Appl. No.: 10/258,158

(22) PCT Filed: Feb. 23, 2001

(86) PCT No.: PCT/EP01/02066

§ 371 (c)(1),
(2), (4) Date: Oct. 18, 2002

(87) PCT Pub. No.: WO01/81762

PCT Pub. Date: Nov. 1, 2001

(65) Prior Publication Data

US 2003/0103851 A1 Jun. 5, 2003

(30) Foreign Application Priority Data

Apr. 20, 2000 (DE) ..... 100 19 724

(51) Int. Cl.[7] ..... F04B 17/00
(52) U.S. Cl. ..... 417/373
(58) Field of Search ..... 417/312, 313, 417/321, 372, 373, 410.1, 413.1; 219/200, 201, 520, 529, 535, 538; 92/1, 140, 153, 156; 166/62

(56) References Cited

U.S. PATENT DOCUMENTS 4,790,730 A 12/1988 Spaeth et al.
5,461,966 A 10/1995 Becker et al.
5,513,956 A * 5/1996 Lewis et al. ..... 417/12

FOREIGN PATENT DOCUMENTS

DE 8602787 3/1986
DE 3526882 1/1987

* cited by examiner

*Primary Examiner*—Charles G. Freay
(74) *Attorney, Agent, or Firm*—Volpe and Koenig, P.C.

(57) ABSTRACT

A measuring gas pump (1) including a pump housing (2) with a pump chamber (3) inside which is sealed by a working membrane (5). The membrane (5) is connected: by a connecting rod (8) or a similar type of lifting device to a crank mechanism (9). A heating device is provided in the upper area of the pump housing, specifically in the pump head (10). On one hand, in the drive-transmission area between the head of the connecting rod (6) on the membrane side and the crank mechanism (9), there are holes (11) for the reduction of heat transfer to the crank mechanism which are spaced in a longitudinal direction of the connecting rod and which are also diametrically opposed, in peripheral direction, with a resulting reduction in heat conductivity. On the other hand, there is an enlargement of the surface area, at least in the area adjacent to the crank mechanism, for purposes of heat dissipation, specifically through cooling ribs (12).

6 Claims, 1 Drawing Sheet

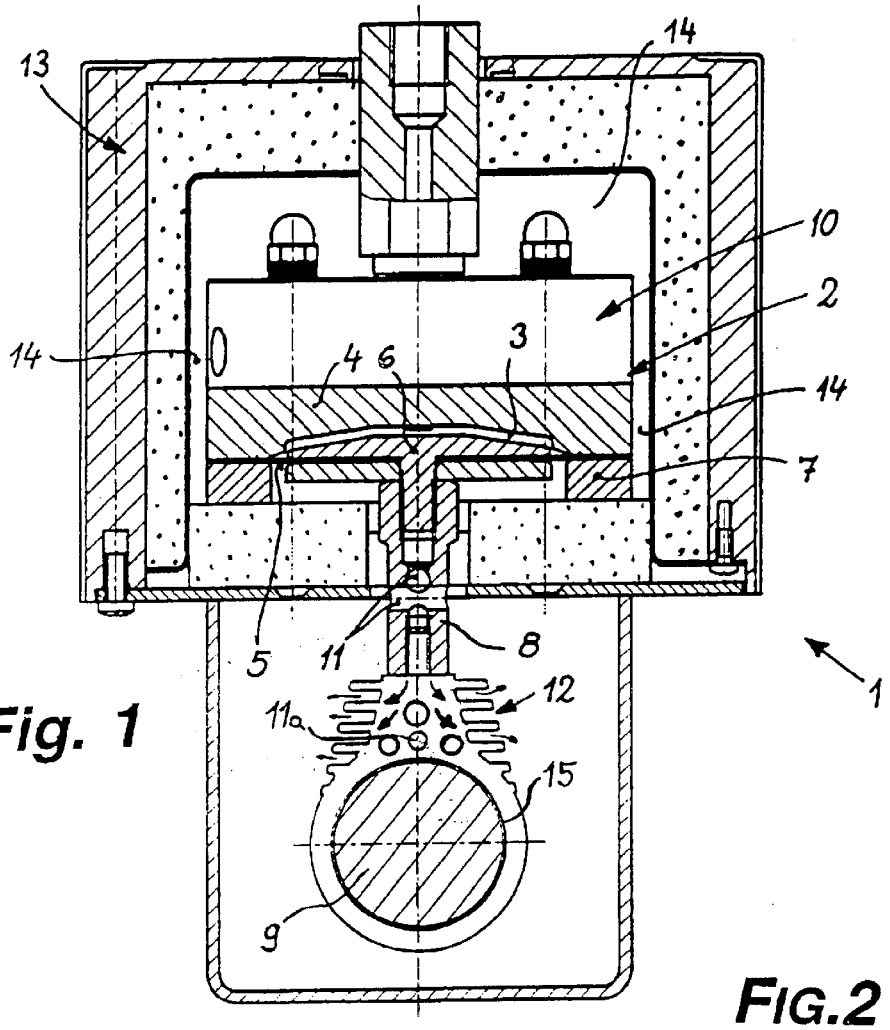
Fig. 1
FIG.2
FIG.3
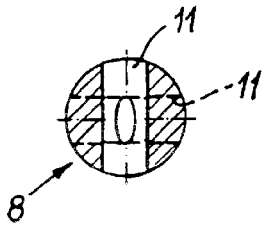
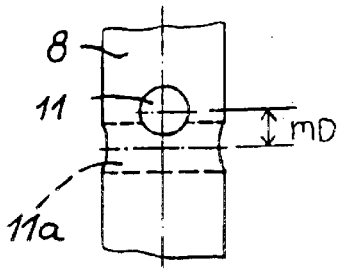

MEASURING GAS PUMP

BACKGROUND

The invention concerns a measuring gas pump with a pump housing containing a pump chamber sealed with a working membrane which is connected to a crank mechanism through a connecting rod with a crank mechanism, and in which a heating device is provided in the upper area of the pump housing, as well as with a heating device located in the upper area of the pump housing. In the drive-transmission area between the head of the connecting rod on the membrane side and the crank mechanism, holes are provided for purposes of reducing heat transfer to the crank mechanism by reducing heat conductivity. These holes are spaced in the longitudinal direction of the connecting rod and are offset in peripheral direction.

In U.S. Pat. No. 4,790,730, a measuring gas pump of the type mentioned above, for the delivery of hot measured gasses, is known, in which the working membrane sealing the pump chamber is connected to a crank mechanism by a connecting rod. In the pump previously known from U.S. Pat. No. 4,790,730, a heating device is located in the upper area of the pump housing. With the help of this heating device, the areas which come into contact with the gas to be measured are supposed to be maintained at a pre-determined temperature equivalent to that of the extraction point of the gas to be measured, in order to prevent a drop in temperature of the gas to be measured in the area of the pump chamber and to avoid a condensation of gas components to be analyzed and a falsification of the measurement results.

In the pump of U.S. Pat. No. 4,790,730, holes, spaced in the longitudinal direction of the connecting rod and offset in peripheral direction, are provided for the purpose of reducing heat transfer to the crank mechanism in the drive-transmission area between the head of the connecting rod on the membrane side and the crank mechanism, therefore reducing heat conductivity. At the same time, however, the connecting rod in the area of these holes features a larger connecting rod cross-section, thus reducing the thermal resistance in an undesirable manner.

SUMMARY

The object of this invention is to reduce the transfer of heat between the pump head and the crank mechanism, particularly to the bearing of the connecting rod, while largely avoiding the disadvantages described above.

In order to accomplish this task, it is suggested that an enlargement of the surface area be provided in the form of cooling ribs, for purposes of heat dissipation, located in the area of the head of the connecting rod adjacent to the crank mechanism where the rod portion of the connecting rod is connected, and that at least one hole be provided for reducing heat conductivity and/or for heat dissipation to the adjacently located cooling ribs in the area between the cooling ribs and the bearing of the connecting rod.

The combination of these simple-to-institute measures leads to an effective reduction of the temperature of the bearing of the connection rod, resulting in a corresponding extension of service life. In the head of the connecting rod adjacent to the crank mechanism of the invented gas pump, one or several holes are also provided in the area between the cooling ribs and the bearing of the connection rod for reducing heat conductivity and/or for dissipating heat to the adjacently located cooling ribs. On the one hand, this reduces the surface area of the heat conducting cross-section. On the other hand, air circulation and, therefore, heat dissipation can be achieved by means of these holes. In addition, this favors the drawing off of heat to the cooling ribs.

Cooling by means of the cooling ribs is especially effective by means of the crank or eccentric movement, so that practically no elevated temperature load on the bearing of the connection rod and its surrounding area occurs, in spite of higher temperatures in the area of the head of the connecting rod.

The holes, spaced on the side and offset in peripheral direction, minimize the heat conducting cross-section of the connecting rod, but reduce the stability only insignificantly by the longitudinal offset of the holes. The heat still occurring at the end of the connecting rod adjacent to the crank mechanism can then be effectively dissipated into the environment through the increase in surface area provided by the cooling ribs.

The adjacent holes should be diametrically opposed at 90° to each other with a medium amount of distance that is no less than the diameter. Through this side offset of the holes in the longitudinal direction of the connecting rod, the holes indeed interlock, the result being an especially good aeration and cooling in this area as well, but the stability of the connecting rod is preserved to the greatest extent possible.

Another advantage is that the connecting rod is made of steel, specifically from stainless steel. Stainless steel has the advantage over the aluminum used most of the time for connecting rods, since it has less heat conductivity but good stability characteristics at the same time.

The described invention is particularly advantageous when used with gas pumps featuring heat insulation that encompasses at least the pump head, so that the heat insulation is primarily established through an isolation housing whose inner wall is spaced from the pump head for the formation of a gas isolation layer. Through this effective insulation of the pump head, practically no heat can escape, so that it becomes particularly important to institute the measures pertaining to this invention for reducing the transmission of heat in the direction of the bearing of the connecting rod and crank mechanism.

BRIEF DESCRIPTION OF THE DRAWINGS

The invention, along with its essential details, is described in more detail below.

In the drawings:

FIG. 1 is a longitudinal section of a measuring gas pump,

FIG. 2 is a partial cutaway of a connecting rod, and

FIG. 3 is a cross-section of a connecting rod in the area of a hole.

DETAILED DESCRIPTION OF THE PREFERRED EMBODIMENTS

A measuring gas pump 1 shown in FIG. 1 includes a pump housing 2 with a pump chamber 3 located inside which is sealed on one side by a pump head cover 4 and on the other side by a working membrane 5 as well as a head of the connecting rod 6. The working membrane 5 is on the outside between the pump head cover 4 and a circular housing part 7 as well as centrally placed on the head of the connecting rod 6 and connected to a crank mechanism 9 through a connecting rod 8 connected to the head of the connecting rod 6.

In this measuring gas pump, which is preferably a heated pump, a eating device is provided in the pump head 10. In this way, the pump head can be heated to over 100° C. as needed. In order to prevent a heat transfer from the pump head 10 to the crank mechanism 9 occurring to a degree that is damaging to the bearing 15 of the connecting rod, measures for reducing the transfer of heat to the crank mechanism 9 are provided in the area of the drive-transmission.

In order to reduce heat conductivity, holes 11 offset in peripheral direction are provided, spaced in the longitudinal direction of the connecting rod. As shown in the enlarged illustration in FIG. 2, it can be clearly seen that nearby holes 11 are placed at 90° to each other, featuring a middle distance MD of less than the hole diameter. The hole channels are connected to each other in this way. In this way, the heat conductivity of the connecting rod 8 is minimized on one hand, while the holes 11 provide good ventilation and therefore good heat dissipation. Through the offset of the holes 11 and the connection of their channels, good stability values are maintained in spite of the reduction of heat conductivity and the increased dissipation of heat achieved. In the preferred embodiment, two adjacent holes 11 are provided. Depending on the length of the connecting rod, however, more than two holes 11 can also be provided.

In order to dissipate heat, an enlargement of the surface area of the connecting rod 8 is provided at least in the area around near the crank mechanism 9 by means of cooling ribs 12. In the preferred embodiment, these are situated in a conical transfer area of the connecting rod 8 near the crank mechanism 9. This achieves an effective dissipation of heat in this area; this can be supported even more by preferably providing one or more additional holes 11*a* between the cooling ribs 12 and the bearing 15 of the connecting rod. The holes 11*a* are situated in such a way that heat transfer to the nearby cooling ribs and a resulting dissipation of heat in that area also takes place, as indicated by the arrows in FIG. 1.

The combination of reduced heat conductivity on the one hand and the increased possibility of heat radiation on the other hand results in a large drop in temperature between the pump head 10 and crank mechanism 9, so that only normal operating temperatures which are non-damaging for the bearing of the connecting rod occur in the area of the pump head 10, in spite of higher operating temperatures.

The measures described above for reducing the heat transfer from the pump head to the crank mechanism, have an especially advantageous effect in a gas measuring pump which includes heat insulation encompassing the pump head, formed primarily by an isolation housing 13 whose inner wall is spaced from the pump head 10 in order to form a gas isolation layer 14 for the pump head 10.

What is claimed is:

1. A measuring gas pump (1) comprising a pump housing (2), with a pump chamber (3) located therein that is sealed with a working membrane (5), that is drivingly connected by a connecting rod (8) to a crank mechanism (9), and include a heating device (10) in an upper area of the pump housing (2), whereby in the drive transmission area between a membrane side of a head (6) of the connecting rod and the crank mechanism (9) to reduce the heat transfer to the crank mechanism (9) by reducing heat conductivity, hole channels (11) are located in the connecting rod spaced in a longitudinal direction and offset in a peripheral direction, characterized in that, for heat dissipation, cooling ribs (12) are provided on the connecting rod (8) adjacent to the crank mechanism where a portion of the connecting rod (8) is connected, and that at least one hole channel (11) for reducing the heat conductivity and/or to dissipate heat to the adjacently located cooling ribs (12) is provided in the connecting rod (8).

2. The measuring gas pump according to claim 1, characterized in that the cooling ribs (12) are provided in a conical junction area of the portion of the connecting rod adjacent to the crank mechanism (9).

3. The measuring gas pump according to claim 1, characterized in that adjacent ones of the hole channels (11) are diametrically opposed to each other at a substantially 90° angle and have a middle distance from each other of less than a diameter of the hole channels.

4. The measuring gas pump according to claim 1, characterized by the connecting rod (8) being formed of steel.

5. The measuring gas pump according to claim 1, further comprising a heat insulation encompassing at least a pump head (10), the heat insulation being principally formed by an isolation housing (13) having an inner wall that is spaced apart from the pump head (10) to form a gas isolation layer.

6. The measuring gas pump pf claim 4, wherein the connecting rod (8) is formed of stainless steel.

* * * * *